United States Patent [19]

Bugnone

[11] 4,171,780

[45] Oct. 23, 1979

[54] FINAL STAGE OF A WEB TREATMENT MACHINE SUCH AS A PRINTING MACHINE

[76] Inventor: Aldo Bugnone, via Bellini, 2, Turin, Italy

[21] Appl. No.: 912,147

[22] Filed: Jun. 2, 1978

[30] Foreign Application Priority Data

Jun. 2, 1977 [IT] Italy ..... 68266 A/77

[51] Int. Cl.[2] ..... B65H 19/20

[52] U.S. Cl. ..... 242/56 A; 242/56.2

[58] Field of Search ..... 242/56 R, 56 A, 64, 242/56.2, 56.3, 56.6

[56] References Cited

U.S. PATENT DOCUMENTS

| | | | |
|---|---|---|---|
| 3,365,141 | 1/1968 | Soloduk | 242/56.6 X |
| 3,592,403 | 7/1971 | Schmitt | 242/56 R |
| 3,857,524 | 12/1974 | Melead | 242/56 R |
| 3,889,892 | 6/1975 | Melead | 242/56 R |

*Primary Examiner*—Edward J. McCarthy

*Attorney, Agent, or Firm*—Sughrue, Rothwell, Mion, Zinn and Macpeak

[57] ABSTRACT

A web winding and cutting apparatus for mounting downstream of the final stage of a web handling machine such as a printing machine includes pressure rollers mounted upon pivoted arms and engageable with the final roller of the machine to draw the web from the final stage, so that a relatively low-torque motor can be employed to drive a core upon which a roll is round. A movable cutter blade may be associated with pivoted arms carrying joining rollers used for pressing the severed leading end portion of the web onto the core to be wound.

21 Claims, 9 Drawing Figures

FINAL STAGE OF A WEB TREATMENT MACHINE SUCH AS A PRINTING MACHINE

The present invention relates to a final stage of a web treatment machine such as, for example, of a printing machine, of the type comprising at least two vertical supports supporting rollers between which a web passes and a device for transverse cutting of the web, associated with winding means for the web.

Traditionally in machines for the treatment of webs of, for example paper, cardboard, plastics and aluminium foil a web winding apparatus is located downstream of the final stage of the machine itself with a dandy roller associated with a winding core for the formation of wound rolls, the core being driven by an applied torque. For the driving of the winding core it is necessary therefore to use a high powered motor so as to ensure a constant pull on the winding web as the diameter of the wound roll increases, since the moment exerted by the web tension at the axis of rotation of the roll increases and has to be overcome by the torque of the motor.

An object of the present invention is the provision of a winding apparatus for association with the final stage of a web treatment machine such that uniformity and constancy of the web winding tension can be ensured with simple and economical means, and such that transverse cutting of the web can be effected in a very short time when winding of a roll is complete.

According to the invention, this object is achieved by a web winding and cutting apparatus for association with the final stage of a machine for the treatment of a web, such as a printing machine, comprising at least two vertical supports, rollers over which the web passes, mounted between the said support, means for transverse cutting of the web, and a web winding unit, wherein the apparatus includes: a final roller, a motor driving said roller; at least one pressure roller engageable with said final roller for drawing the web from said final stage; a core upon which a roll is formed by winding of the web in said winding unit, means for rotating said core, means for bringing said roll into driving engagement with the said final roller to drive the roll, a movable knife for engagement with the web, constituting said cutting means, and means for joining the severed leading end portion of the web to said core.

By virtue of this invention it suffices to drive the final roller of the final stage by a motor of minimal and constant torque since the motor is not subject to the effects of the variation of diameter of the roll formed on the core. This final roller, together with the pressure roller, acts to nip the web and bears upon the surface of the roll being wound in the winding unit, acting therefore at the periphery of the roll being wound, independently of variation in the diameter of the roll.

The core of the winding unit is preferably driven by a motor of small power in order to overcome friction satisfactorily, but in any case a driven dandy roller is no longer necessary.

Preferably, the final roller is coupled selectively with a pressure roller disposed above it, or with a pressure roller disposed beneath it, each said pressure roller being urged against the said final roller by pressure means. This has the advantage that it is possible to wind the web clockwise or anticlockwise, allowing different possibilities for the passage of the web and allowing the direction of rotation of the final roller to be reversed.

According to a preferred feature of the invention, the means for joining the severed leading end portion of the web to the core comprise two parallel arms each of which is articulated to one of said supports and at least one joining roller mounted between said arms and adapted to bear against said core upon pivotal movement of said arms.

With the arms there may be associated a movable knife which can be moved towards the tape to be cut by means of a pneumatic actuator or the like.

In traditional machines, the means for joining the severed leading end portion of the web to the core move into an operative position when the changing of the wound roll has already taken place with loss of time and with winding anomalies. The aforementioned characteristics of this invention, and the fact that the positions of the knives and of the joining means can be regulated in dependence upon the diameter of the core, enable the joining means to be always in the correct position to perform the joining operation, since it is possible to position them correctly for each diameter of winding core. The only movement which the joining means perform is that of the triggering of the knife for cutting the web when the roll being wound has reached the required diameter.

According to an alternative embodiment of the invention, the means for joining the severed leading end portion of the web to the core comprise a bar of resilient material such as foam rubber associated with the knife and adapted, at the moment of cutting of the web, to press the severed leading end portion of the web against a part of the core having adhesive such as glue applied thereto, and including pneumatic actuator means for moving the knife against the web. The joining means may, however, perform the joining without the use of adhesive. For example, a number of joining rollers may be arranged around the core to apply pressure to the latter to press the severed leading end portion of the web onto the core to be wound around the latter to form a new roll.

In one embodiment of the apparatus there may be two knives and two joining means situated symmetrically with respect to the final roller, in which case web cutting can be effected regardless of the direction of movement of the web. In this case the blade opposite that which performs the cut may carry the aforesaid means to facilitate the winding without glue, whilst, in the case of a single joining means the means to facilitate the joining without glue will be similar to that placed on the opposite side of the web.

In one embodiment of the invention the apparatus includes means supporting the winding unit for displacement with respect to the final roller so as to maintain a substantially constant pressure between the final roller and the roll being wound in the winding unit. Preferably, the final roller has sensing means for measuring said pressure, and means for controlling the displacement of the winding unit to regulate said pressure in dependence upon the pressure measured by the sensing means.

The winding unit preferably has a central shaft to which are fixed at least two arms or yokes each carrying a core between corresponding ends.

Normally in winding machines pressure is applied to a roll being wound through a pressure roller mounted on two arms so as to be able to engage the roll core. When changing the roll being wound, this roller is lifted away to enable the winding core or mandrel to be changed, which takes a relatively long time during which the web is wound without the accompaniment of the pressure roller. This results in the winding of some turns of the roll in an anomalous way, with overlapping of web strips if the web has previously been cut longitudinally and difficulty in successively detaching the rolls. This inconvenience is made worse by the lack of accompanying undivided web, and by the fact that such longitudinal cutting of the web normally takes place at some distance from the winding unit.

In a preferred embodiment of the invention there is provided a single unit comprising the web cutting means and the means for joining the severed end portion of the web to the core, allowing changing of the rolls in very short times and allowing the maximum speed of the joining means, thus eliminating the aforesaid faults, and preventing swerving and anomalies in the web and difficulties at the moment of separation of the wound rolls.

The pressure between the final roller and the roll being wound may be applied by means of a pneumatic actuator, hydropneumatic actuator or the like, and is preferably kept constant irrespective of the diameter of the roll being formed. The said roll, as it increases in diameter, presses against the final roller, which may be provided with sensing means to generate a first signal which is utilized in control means to displace the wound roll away from the final roller until a second signal is given by the sensing means, in response to which the movement of the roll is stopped. Such automatic control may be maintained as the diameter of the wound roll increases.

In one embodiment of apparatus according to the invention longitudinal web cutting means are disposed adjacent the final roller for cutting the web longitudinally.

In traditional web treatment machines the final stage usually has the sole aim of rewinding the web. The final stage seldom has any other function such as dividing the web into two or more strips which are subsequently wound onto separate rolls. In the latter case it is necessary to remove the central strip of material, of about 8 to 10 mm width, so as to allow winding onto a same core of the two rolls which derive from it without any interference between the strips, particularly when winding in two positions with the automatic roll change means and cutting means consequently at some distance from each other.

In the aforesaid embodiment of the present invention the longitudinal cut is made during the operation on the web itself, close to the final roller, with automatic change on a double winding unit, without it being necessary to remove any part of the web between one roll and the other roll to be wound.

Preferably the longitudinal cutting means are removable away from the final stage.

This has the advantage that, while a certain type of web operation is being carried out, it is possible to prepare, away from the web-handling machine, longitudinal cutting means, or alternative said cutting means, with cutting characteristics for a successive operation, allowing the operator to reduce considerably the dead time of the machine, and to reduce the time necessary for preparing the machine, with more effective and stimulating employment of the staff attending the machine.

Preferably, the longitudinal cutting means are adjustable in the transverse and longitudinal direction with respect to the direction of movement of the web.

In machines which perform more than one operation on a web, such as, for example, multiple-colour printing machines, means may be provided for controlling the successive operating stages of the machine for the purpose of obtaining optimal functioning with accurate registration between the various operations, utilising therefore longitudinal cutting means which are adjustable laterally relative to the web in order to perform cutting operations on the web in registration with the preceding operations on the web.

The invention will be further described, by way of non-limiting example, with reference to the accompanying drawings, wherein.

Figure 1:
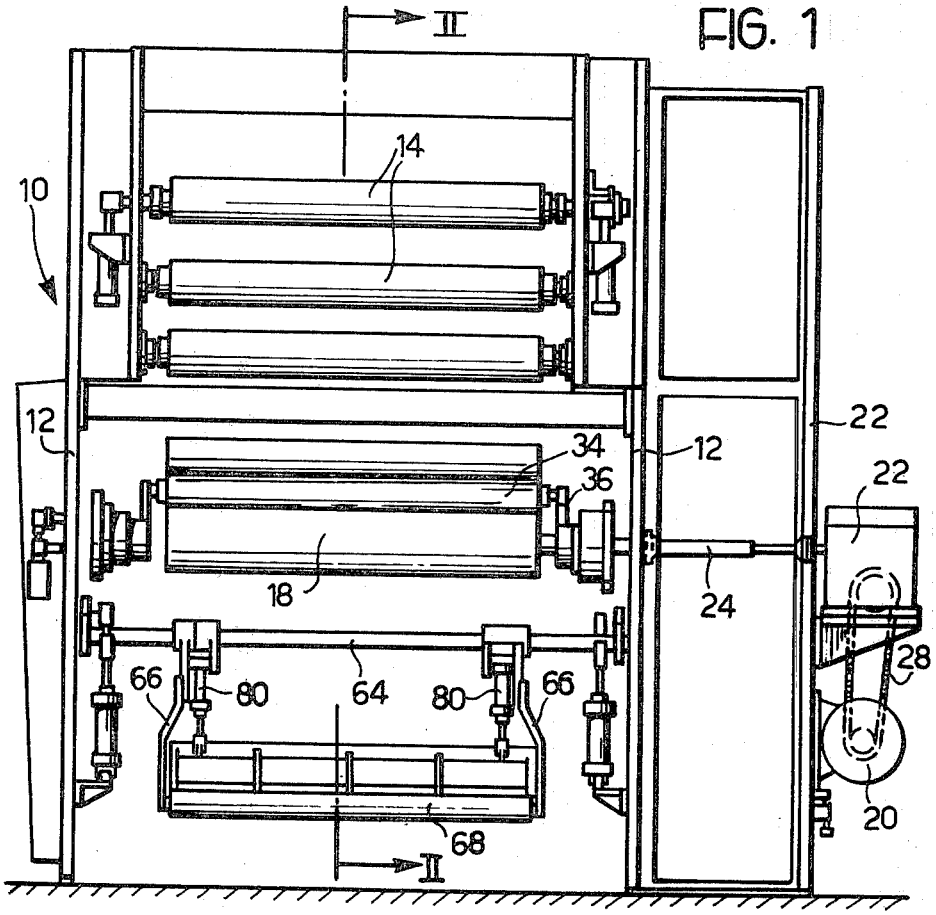
FIG. 1 is a schematic front elevational view of the final stage of a printing machine, in the direction of the arrow I in FIG. 2, showing part of apparatus according to the invention without the winding unit.
Figure 2:
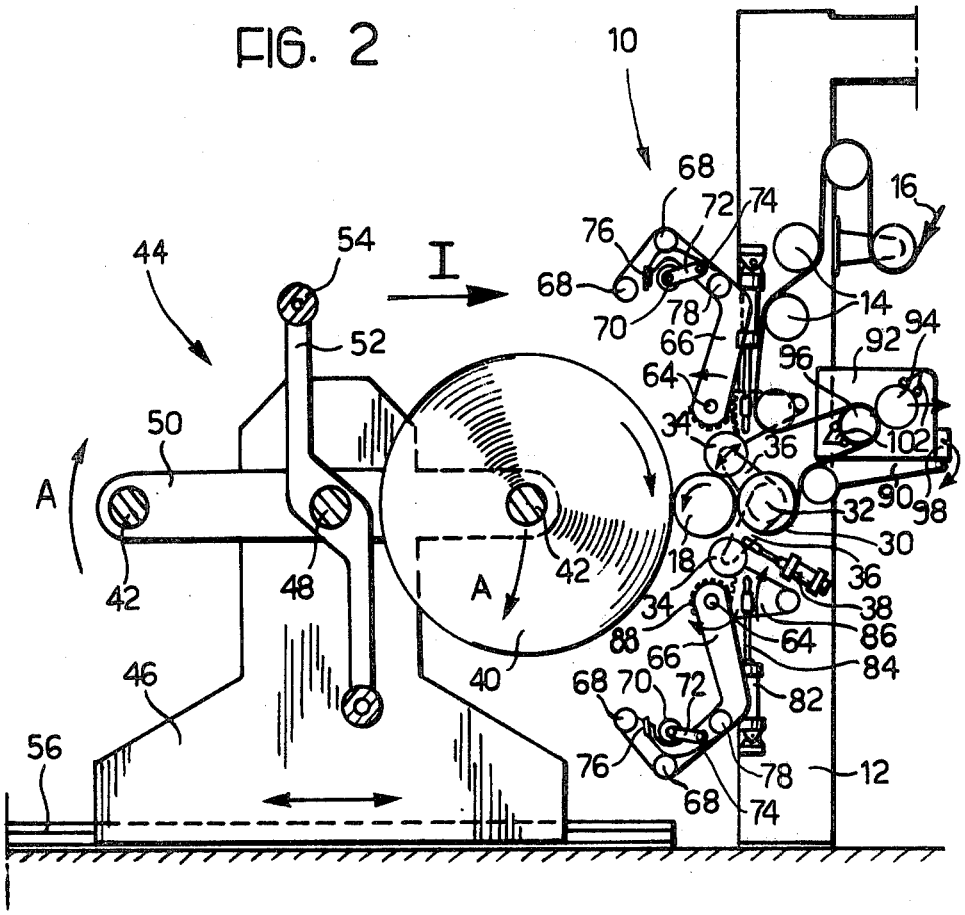
FIG. 2 is a longitudinal section on the line II—II of FIG. 1, illustrating a first embodiment of the invention with the final stage in a first working phase.
Figure 3:
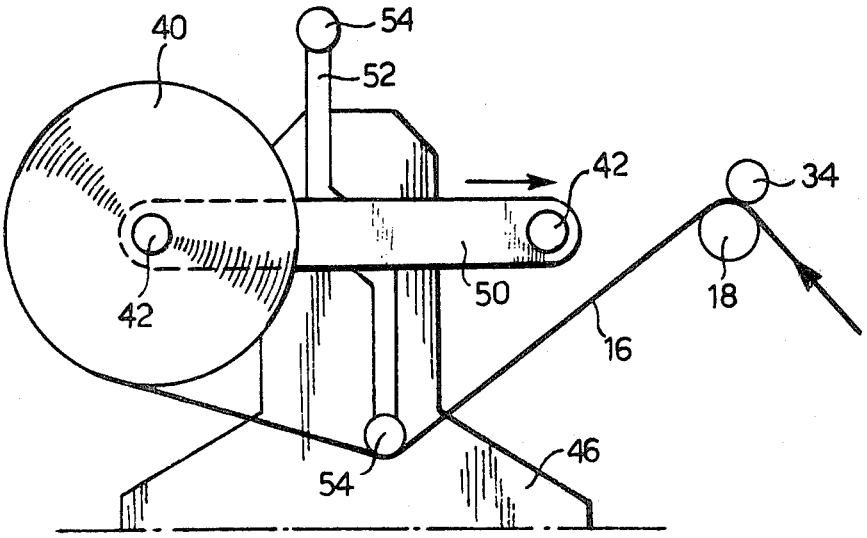
FIG. 3 is a partial schematic cross section, similar to that of FIG. 2, showing a subsequent working phase.

FIGS. 1 and 2 illustrate schematically a final stage 10 of a printing machine which comprises two vertical fixed supports 12 which support rollers 14 around which a web 16 passes, the web being omitted from FIG. 1 for the sake of clarity.

The final stage 10 has a final roller 18 driven by a motor 20. The motor 20 is mounted on an auxiliary support 22 parallel to the two vertical supports 12. Rotary drive is transmitted to the final roller 18 from the motor 20 through an endless belt or chain 28, a transmission box 26 and a cardan shaft 24.

The auxiliary support 22 forms with the adjacent support 12 an ideal mounting for other motors, reduction gears, drive transmissions, service conduits, cables and the like, not shown, and also constitutes protection for the more delicate parts.

As illustrated in FIG. 2, the final roller 18 is coupled by the web 16 to an immediately preceding idle roller 30 to the axis 32 of which is parallel to and at the same height as the axis of the final roller 18.

The final roller 18 is engageable selectively with two pressure rollers 34 of rubber of like resilient material, one of which is above and the other below the roller 18. Each pressure roller 34 is mounted at the end of a respective pair of arms 36. Each pair of arms 36 is pivotable about a common axis which coincides with the axis 32 of the idle roller 30. Each of the pressure rollers 34 can be urged selectively into contact with the final roller 18 by an hydraulic actuator 38. For the direction of movement of the web 16 illustrated in FIG. 2, the upper pressure roller 34 is pressed against the final roller 18, while the lower pressure roller 34 is spaced from the final roller 18 and therefore out of action.

The combined action of the final roller 18 driven by the motor 20 and the associated pressure roller 34 draws the web 16 from the final stage 10 of the printing machine onto a roll 40 which is wound continuously on a core 42 carried by a winding unit 44.

Figure 9:
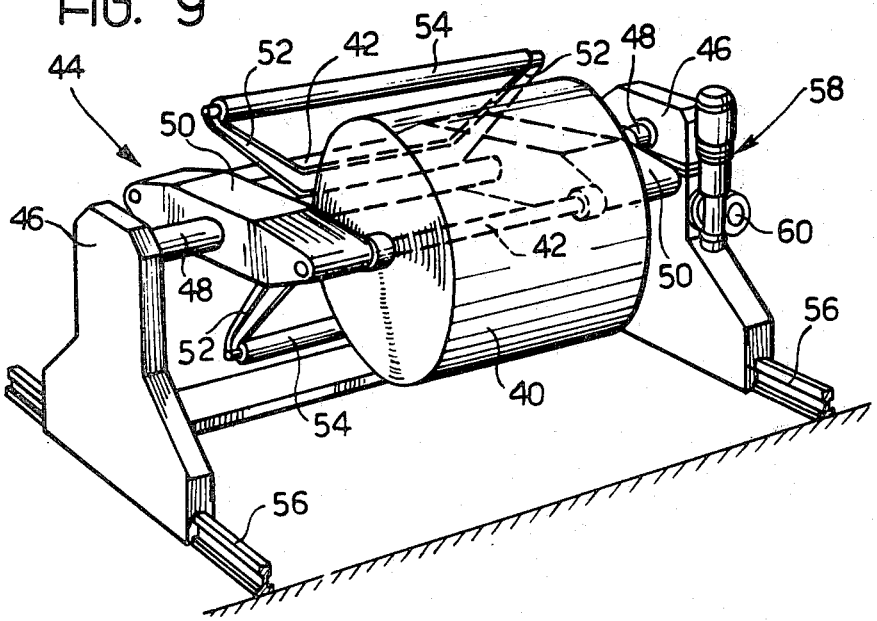
FIG. 9 is a perspective and schematic view of a web winding unit employed in the illustrated embodiments of the invention.

The winding unit 44 is illustrated schematically in FIG. 9. It has two lateral support stanchions 46 between which a rotatable shaft 48 is supported. The shaft 48 supports two parallel yokes 50 near the respective stanchions 46 and between the yokes 50 the shaft 48 supports two brackets 52 disposed in planes perpendicular to the yokes 50. Each bracket 51 is bifurcated and supports at its free ends, a respective deflector roller 54. Between their opposite ends the two yokes 50 support two parallel cores 42 on which the rolls 40 are wound consecutively. Each core 42 is rotatably driven by a motor (not shown) carried by the respective yoke 50. This motor is of low constant torque, sufficient to overcome and annul frictional drag, the drawing of the web 16 from the exit of the final stage 10 onto the roll 40 in the winding unit 44 being effected by the final roller 18.

Each stanchion 46 of the winding unit 44 is mounted on rails 56 and the entire winding unit 44 can be moved horizontally by means of a motor, not shown, in a direction perpendicular to the axis of the shaft 48.

A motor 58 and an associated reduction gear 60 is mounted on one side of one of the stanchions 46 for the purpose of rotating the shaft 48 so as to rotate the two yokes 50, in the direction of the arrow A in FIG. 2, through 180°.

Figure 6:
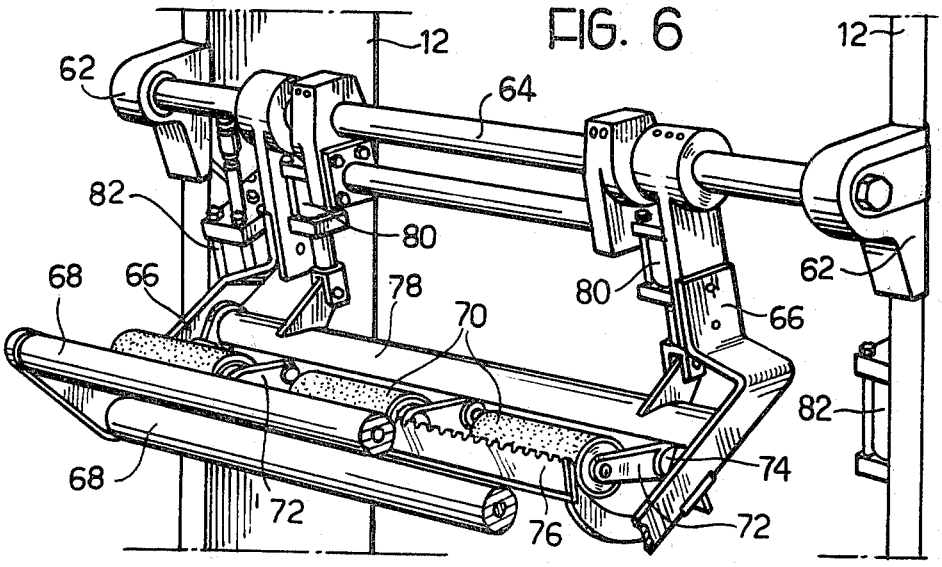
FIG. 6 is a perspective view of the means for joining the severed end of the web to a core, and the cutting device.

The two supports 12 of the final group 10 are provided (FIG. 6) with two pairs of lugs 62 which support two parallel shafts 64 arranged symmetrically with respect to the final roller 18, shaft 64 being above and the other below the said roller 18 (FIG. 2). On each shaft 64 there is keyed a pair of arms 66 between the free ends of which a respective pair of deflector rollers 68 are mounted rotatably. For the sake of clarity only the lower pair of arms 66 is shown in FIG. 1 and in the same Figure the lower pressure roller 34 is not illustrated.

Between each pair of arms 66 a series of rotatable coaxial joining rollers 70 are mounted upon respective arms 72 fixed to a common shaft 74 extending between the arms 66. The joining rollers 70 can be supported in a number of parallel rows.

Between each pair of arms 66 there is also articulated a knife 76 supported for pivotal movement, under control of pneumatic actuators 80, about the axis of a shaft 78 extending between the arms 66.

Each pair of arms 66 is rotatable with the shaft 64 by means of a pair of pneumatic actuators 82 having piston rods 84 articulated to toothed sectors 86 which cooperate with toothed wheels 88 fixed to the respective arms 66.

As shown in FIG. 2, each support 12 of the final stage 10 carries a fixed cantilever bracket 90 for the support of a longitudinal web slitting unit 92. This unit 92 includes a shaft 94 carrying knives and a shaft 96 carrying cooperating anvil elements. The longitudinal web slitting unit 92 can be of any traditional type, operating, for example, by applying cutting pressure, cutting by means of blades, or cutting with a shearing action through cooperating shears. The shafts 92, 96 are supported by supports 102 which are distributed axially along the respective shafts. By supporting the shafts 92 and 96 at a number of axially distributed points in this way, flexing of the shafts 92 and 96 is limited, even for very high widths of the web 16, so that the knives and anvil elements carried by the shafts can have a constant diameter.

The free end of each cantilever bracket 90 carries a rotatable stop 98 which can be rotated into an upstanding position retaining the unit 92 in its working position and which can be lowered to permit removal of the unit 92 and its replacement as indicated by arrows in FIG. 2. Different units 92, prepared, possibly outside the machine, for different web cutting operations, may therefore be substituted easily.

The whole unit 92 can be aligned manually or automatically in a direction transverse to the direction of movement of the web 16 for the purpose of performing the longitudinal cutting of the web at positions in register with preceding operations.

Since the longitudinal web cutting unit 92 is placed very near the winding unit the longitudinal slitting of the web 16 can be effected while working on the web prior to winding thereof, without it being necessary to remove any portion of the web between one and the other of the rolls 40 to be wound. In the case where the web 16 is to be cut longitudinally, then each core 42 upon winding of the web will carry two or more rolls 40 adjacent one another end-to-end.

The operation of the device illustrated in FIGS. 1 to 6 or 9 will now be described.

Figure 4:
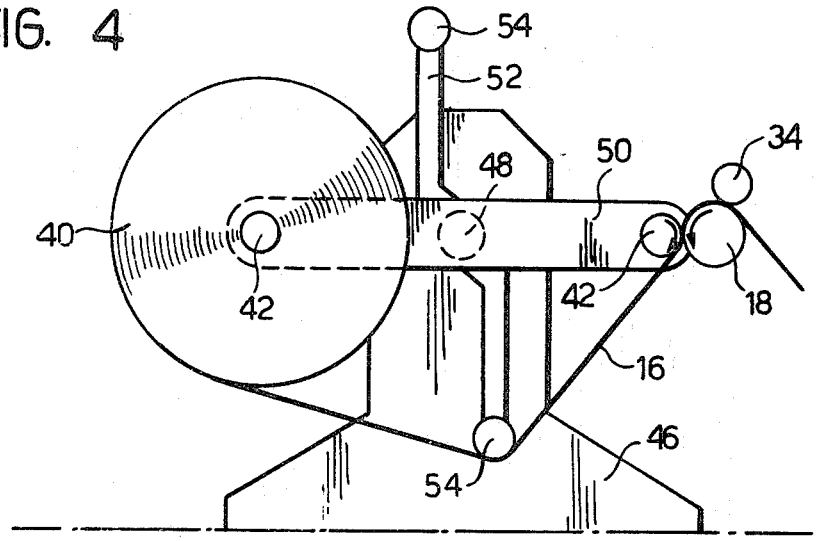
FIG. 4 is a similar cross section to that of FIG. 3, showing a third working phase.

When the roll 40 wound on the core 42 of the winding unit 44 is complete, the yokes 50 are rotated upon the shaft 48 by means of the motor 58. This movement, in the direction of the arrows A in FIG. 2, is initially very fast, but shortly before the end of this movement the yokes 50 are braked and move gently into the reversed position, illustrated in FIG. 3, after a total rotation of 180°. The winding unit 44 is then advanced towards the final stage 10, by means of the motor (not shown) connected to the stanchions 46, until the core 42 comes into contact with the final roller 18 (FIG. 4). The two lower arms 66 are then made to rotate into the position illustrated in FIG. 5, in which the web 16 passes from the final roller 18, around the core 42, over the two deflector rollers 68 and finally over the lower deflector roller 54 of the winding unit 44 before winding onto the full roll 40.

Figure 5:
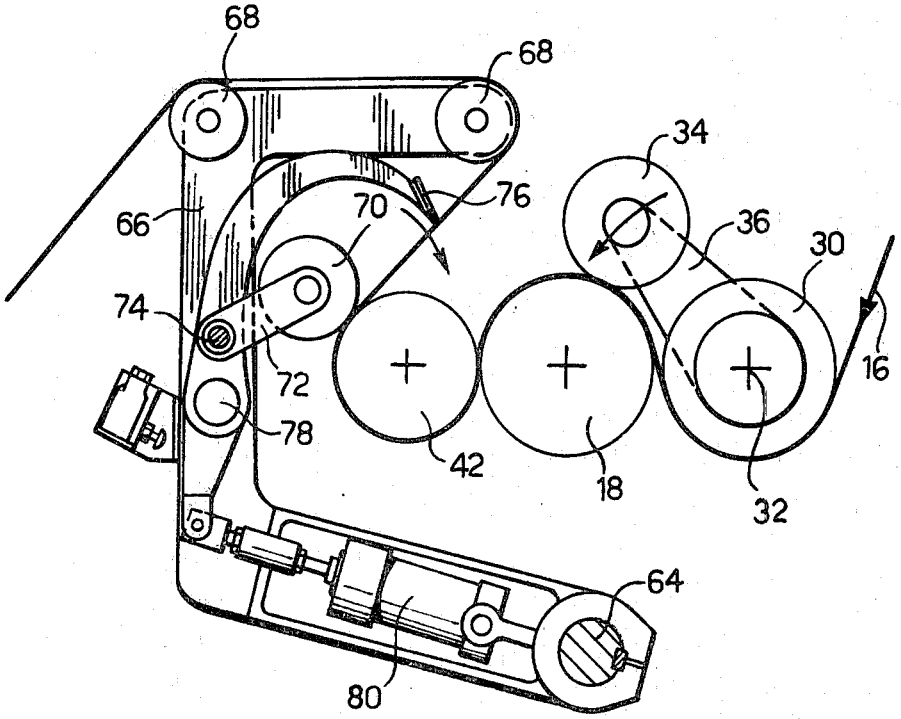
FIG. 5 is a similar cross section to that of FIGS. 2–4, showing a final working phase, on an enlarged scale.

The movable knife 76 is now triggered, moving rapidly against the portion of the web 16 between the upstream deflector roller 68 and the empty core 42, as shown in FIG. 5, so as to cut the web 16 transversely. The 'tail' portion of the web 16 downstream of the cut is wound onto the roll 40 by means of the motor which drives the core 42 of the roll 40, while the leading edge of the upstream portion of the web 16 begins winding on the core without glue. The joining of this leading edge portion of the web 16 to the empty core 42 is ensured by the fact that the knife 76 after severing the web 16 nips the leading edge portion of the web 16 so as to grip said edge portion between the core 42 and the final stage roller 18.

During the latter movement the joining rollers 70 are brought to bear upon the surface of the web 16, pressing against the core 42 by means of elastic biassing elements (not shown) such as, for example, springs wound around the shaft 74. The joining rollers 70 engage the core 42 irrespective of its diameter, ensuring the perfect nipping of the severed end portion of the web, and thereby guiding the leading end portion so as to form the first coils of the new roll 40 to be wound.

During the formation of the new roll 40, the roll 40 already complete can be removed and a new core 42 can be placed between the yokes 50, after the latter have been moved to the position shown in FIG. 2.

Figure 7:
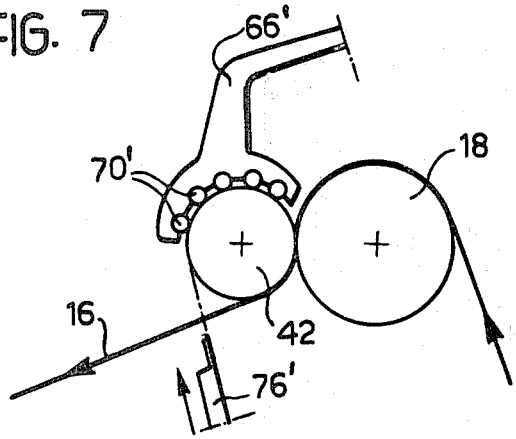
FIG. 7 is a schematic side elevational view similar to that of FIG. 5, illustrating a variant thereof.

In the variant illustrated in FIG. 7, the joining of the severed leading end portion of the web 16 to the core 42 takes place by means of a series of joining rolls 70', distributed around the perimeter of the core 42 and mounted between a pair of pivoted arms 66'. A knife 76' is mounted for movement tangentially with respect to the core 42, thus allowing, at the moment of cutting, the insertion of the severed leading end portion of the web 16 between the joining rollers 70' and the core 42.

Figure 8:
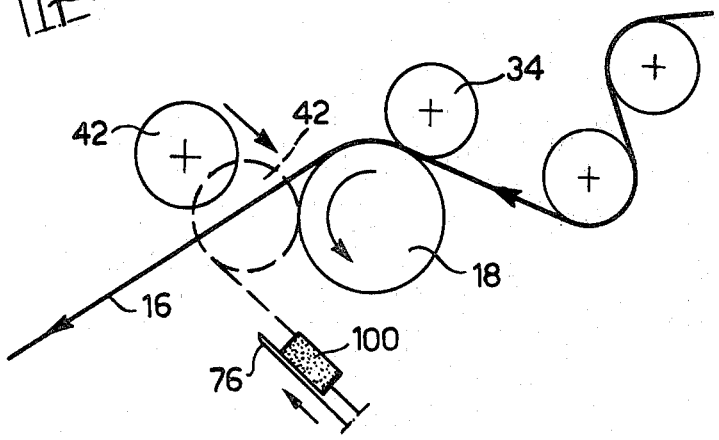
FIG. 8 is a schematic side elevational view similar to that of FIG. 7, showing another variation of the invention.

In the variant illustrated in FIG. 8 the joining of the severed leading end portion of the web 16 to the core 42 is effected by means of glue or like adhesive applied to a peripheral part of the core itself. In this variant the knife 76 is associated with a transverse bar 100 of foam-rubber having a flat face, remote from and parallel to the knife 76, which has a tangential direction with respect to the core 42. In consequence, at the moment of the cutting of the web 16 the severed leading end portion is pressed by the foam-rubber bar 100 against the part of the core 42 which has glue or like adhesive applied thereto.

The final roller 18 is movable with respect to the roll 40 being wound. The final roller 18 furthermore has sensing means, known in the art and not shown in the drawings, for measuring and regulating the pressure between the roll 40 being formed and the roller 18 itself. Such sensing means are connected to control means for effecting horizontal adjustment of the position of the winding unit 44 on the rails 56. By this means the roll 40 being wound, as it increases in diameter, pushes on the final roller 18 until a signal is provided by the sensing means to cause the control means to effect displacement of the winding unit 44 until a second signal, originated by the return to its original position of the final roller 18, halts further such displacement of the winding unit 44. This control cycle continues as the diameter of the roll 40 increases, the pressure between the final roller 18 and the roll 40 being wound being maintained substantially constant, independently of the diameter of the roll 40.

The final stage 10 according to this invention as herein described can be applied not only to printing machines but also to web spraying or painting machines, or machines which distribute liquids, pastes or powders, or indeed machines which treat webs of any material such as, for example, embossing, cutting or die-cutting machines or the like.

It will be understood that while adhering to the principle of this invention, manufacturing details and practical embodiments can be varied widely with respect to what has been described and illustrated by way of example, without departing from the scope of this invention.

I claim:

1. Web winding and cutting apparatus for association with the final stage of a machine for the treatment of a web, such as a printing machine, comprising at least two vertical supports, rollers over which the web passes, mounted between the said supports, means for transverse cutting of the web, and a web winding unit, wherein the said apparatus includes:

a final roller, a motor driving said roller; at least one pressure roller engageable with said final roller for drawing the web from said final stage;

a core upon which a roll is formed by winding of the web in said winding unit, means for rotating said core, means for bringing said roll into driving engagement with the said final roller to drive the roll, a movable knife for engagement with the web, constituting said cutting means, means for joining the severed leading end portion of the web to said core, upper and lower pressure rollers adapted to be coupled selectively with the said final roller, and pressure means for urging one of said pressure rollers selectively against said final roller.

2. Apparatus as defined in claim 1, including a respective pair of arms supporting each pressure roller at opposite ends, and means for rotating each pair of arms around a common axis to effect selective movement of the associated pressure roller towards the final roller.

3. Apparatus as defined in claim 2, including an idle roller the axis of which coincides with the common axis of rotation of said two pairs of arms, the web passing over said idle roller immediately upstream of the final roller.

4. Apparatus as defined in claim 1, including means supporting at least the final roller for movement relative to the roll being wound in the winding unit.

5. Apparatus as defined in claim 1, wherein the pressure rollers are of resilient material such as rubber.

6. Apparatus as defined in claim 1, wherein the motor driving the final roller is mounted upon an auxiliary support fixed to one of said vertical supports and including a cardan shaft coupling said motor to the final roller.

7. Apparatus as defined in claim 1, wherein the final roller is rotatable selectively in opposite directions.

8. Apparatus as defined in claim 1, wherein the means for joining the severed leading end portion of the web to the core comprise two parallel arms each of which is articulated to one of said supports and at least one joining roller mounted between said arms and adapted to bear against said core upon pivotal movement of said arms.

9. Apparatus as defined in claim 8, wherein said arms support a series of said joining rollers distributed around the perimeter of the core.

10. Apparatus as defined in claim 8, wherein said arms support a series of said joining rollers spaced apart axially with respect to the core.

11. Apparatus as defined in claim 8, wherein said arms support said movable knife for movement against the web to sever the latter, and including pneumatic actuator means for effecting cutting movement of said knife.

12. Apparatus as defined in claim 11, wherein the knife is displaceable towards said at least one joining roller in a direction substantially tangential with respect to the surface of the core.

13. Apparatus as defined in claim 11, wherein the knife is pivotably supported between the two arms and is displaceable from the same side of the web as that on which said at least one joining roller is located, and including at least one web deflector roller supported at the free ends of the arms.

14. Apparatus as defined in claim 1, wherein the means for joining the severed leading end portion of the web to the core comprise a bar of resilient material such as foam rubber associated with the knife and adapted, at the moment of cutting of the web, to press the severed leading end portion of the web against a part of the core having adhesive such as glue applied thereto, and including pneumatic actuator means for moving the knife against the web.

15. Apparatus as defined in claim 1, including two said knives and two said joining means situated symmetrically with respect to the final roller.

16. Apparatus as defined in claim 1, wherein the positions of the knife and of the joining means are adjustable according to the diameter of the core.

17. Apparatus as defined in claim 1, including means supporting the winding unit for displacement with respect to the final roller so as to maintain a substantially constant pressure between the final roller and the roll being wound in the winding unit.

18. Apparatus as defined in claim 1, including longitudinal web cutting means disposed adjacent the final roller for cutting the web longitudinally.

19. Apparatus as defined in claim 18, wherein the longitudinal cutting means are removable away from the final stage of the machine.

20. Apparatus as defined in claim 18, wherein the longitudinal cutting means are adjustable in position in the transverse and longitudinal direction with respect to the direction of movement of the web.

21. Apparatus as defined in claim 18, wherein the longitudinal web cutting means comprise knives and cooperating anvil elements mounted upon respective shafts and a plurality of supports axially spaced apart along the respective shafts for supporting the latter.

* * * * *